United States Patent [19]

Browne

[11] Patent Number: 5,050,325

[45] Date of Patent: Sep. 24, 1991

[54] DISPLAY INDICATOR AND REED SWITCH

[75] Inventor: John Browne, Oakville, Canada

[73] Assignee: Dayco Products Canada, Inc., Weston, Canada

[21] Appl. No.: 522,739

[22] Filed: May 14, 1990

[51] Int. Cl.[5] ..... G09F 3/04

[52] U.S. Cl. ..... 40/447; 40/452; 40/449; 340/764

[58] Field of Search ..... 40/449, 447, 446, 452; 340/764, 815.2, 815.07, 765, 815.04, 815.05, 815.27, 815.26, 783

[56] References Cited

U.S. PATENT DOCUMENTS 4,833,806 5/1989 Gars ..... 40/447
4,851,832 7/1989 Graf ..... 40/446 X
4,914,427 4/1990 Trunk ..... 40/452 X
4,974,353 12/1990 Norfolk ..... 40/447

FOREIGN PATENT DOCUMENTS 2804153 8/1978 Fed. Rep. of Germany ..... 40/449

*Primary Examiner*—Kenneth J. Dorner
*Assistant Examiner*—J. Hakomaki

[57] ABSTRACT

The present invention relates to a display device with a movable element. The movable element is driven between ON and OFF positions by switching the polarity of a first high remanence magnetic core. A reed switch is located in the flux path of the switchable magnetic core and of a second magnetic core such that the reed switch assumes open and closed states. The reed switch is connected so that one state turns on or exposes a light source and the other state turns off or masks the light source.

15 Claims, 6 Drawing Sheets

18

42
40
20
28
22A
16
14B
44
14A
46
26
12

DISPLAY INDICATOR AND REED SWITCH

This invention relates to a display element designed to provide a bright or dark appearance either as a single element or as a pixel in an array, using a reed switch, and also relates to a reed switch control arrangement.

The display elements with which the invention is concerned have a movable element movable relative to a stationary element between ON and OFF positions and in these positions to provide a bright area or a dark area, respectively, visible in the viewing direction. A permanent magnet is provided movable with the movable element. A switchable magnetic core is provided on the stationary element located and adapted in one and the other polarity to cooperate with the permanent magnet to move the movable element to ON and OFF position, respectively. Preferably the core is of a high remanence material surrounded by an energizing winding which may be pulsed by an energizing current to switch the core polarity in an interval much less than the interval for the movable element to move between ON and OFF position.

Display devices as described above are well known to those skilled in the art and patents thereto include:

U.S. Pat. No. 4,860,470 to John Browne, dated Aug. 29, 1989, Assigned to NEI Canada Limited U.S. Pat. No. 4,744,163 to John Browne et al, dated Jul. 17, 1988, Assigned to NEI Canada Limited U.S. Pat. No. 4,566,210 to Donald Winrow et al, dated Jan. 28, 1986, Assigned to NEI Canada Limited U.S. Pat. No. 4,426,799 to Donald Winrow dated Jan. 24, 1984, Assigned to NEI Canada Limited In some aspects this invention is particularly concerned with display elements as above defined where the display of the bright area in the viewing direction in the ON position is augmented by a luminous source such as a light emitting diode ('LED') or an optic fibre and where such source must be turned off or masked from the viewer in the OFF position. An example of such display element using an optic fibre is U.S. Pat. No. 4,833,806 to Jacques L. Gars, dated May 30, 1989, Assigned to Societe D'Etudes Pour Le Devoloppment It is useful to note that such light-augmented element is particularly useful with 'writable' highway signs which are adapted to be read from some distance. Such signs will be formed of an array of display elements acting as pixels individually selectively switchable to display light or dark areas collectively providing information to the motorist. With such signs it is frequently desirable that the luminous source be focussed to a beam about the viewing direction narrower than the viewing cone of the element as a whole to attract the driver's attention so that he, then, looks at the display as a whole, obtaining the information it displays from the collective effect of both its bright areas and dark areas with the bright areas augmented by the luminous sources in each pixel.

It is an object of one aspect of the invention to provide a display element with electromagnetic drive where a reed switch (having open and closed states) is arranged to be switched by the stationary member core:

(a) to a state to illuminate or expose the light source to the viewer; or (b) to a state to turn off or mask the light source from the viewer.

Thus the display element which is light-augmented in its ON position, defines a viewing cone centered about a viewing direction which viewing cone may have an apex angle larger than 90° and where within the cone there is a smaller focussed light beam cone when the element is ON with an apex angle of about 15° within the viewing cone.

It is an object of the invention in the aspect discussed in the previous paragraph to provide a reed switch located to be influenced by both the stationary element switchable core (sometimes referred to as the 'first core') and by a high remanence second core. The first and second cores are approximately parallel and located and adapted so that when both cores have similar polarity the collective return flux of the two cores causes the switch to assume one state and when the two cores have opposite polarities causes the switch to assume the other state. The switch is connected so that one state turns on or exposes the light source and the other state turns off or masks the light source. There is thus provided a light augmented display element with ON and OFF states where the control of the light augmentator is more convenient than with prior arrangements.

For example in U.S. Pat. No. 4,833,806 the masking of the light source (there an optic fibre) requires either 180° rotation of the disk or the presence of a special masking addition to the disk. The 180° rotation reduces the strength of the magnetic drive while the masking addition adds to the cost of the disk. In comparison the reed switch controlled by the switchable core provides a easy control for switching on and off a light source such as an incandescent lamp or LED. In the case of a glass fibre, the reed switch may be connected to operate a shutter in the optic path, which includes the fibre, or, if the fibre has an individual light source may switch on and off that source like the lamp or LED in the previous example.

The reed switch controlled by the switchable core may be used for other purposes than control of the light source or light path. For example the reed-switched line may be used to signal the magnetic core state back to a scanner or control. The controlled reed switch could be used for other purposes, such as driving a slave display, of the same or different type.

In drawings which illustrates a preferred embodiment of the invention:

Figure 1:
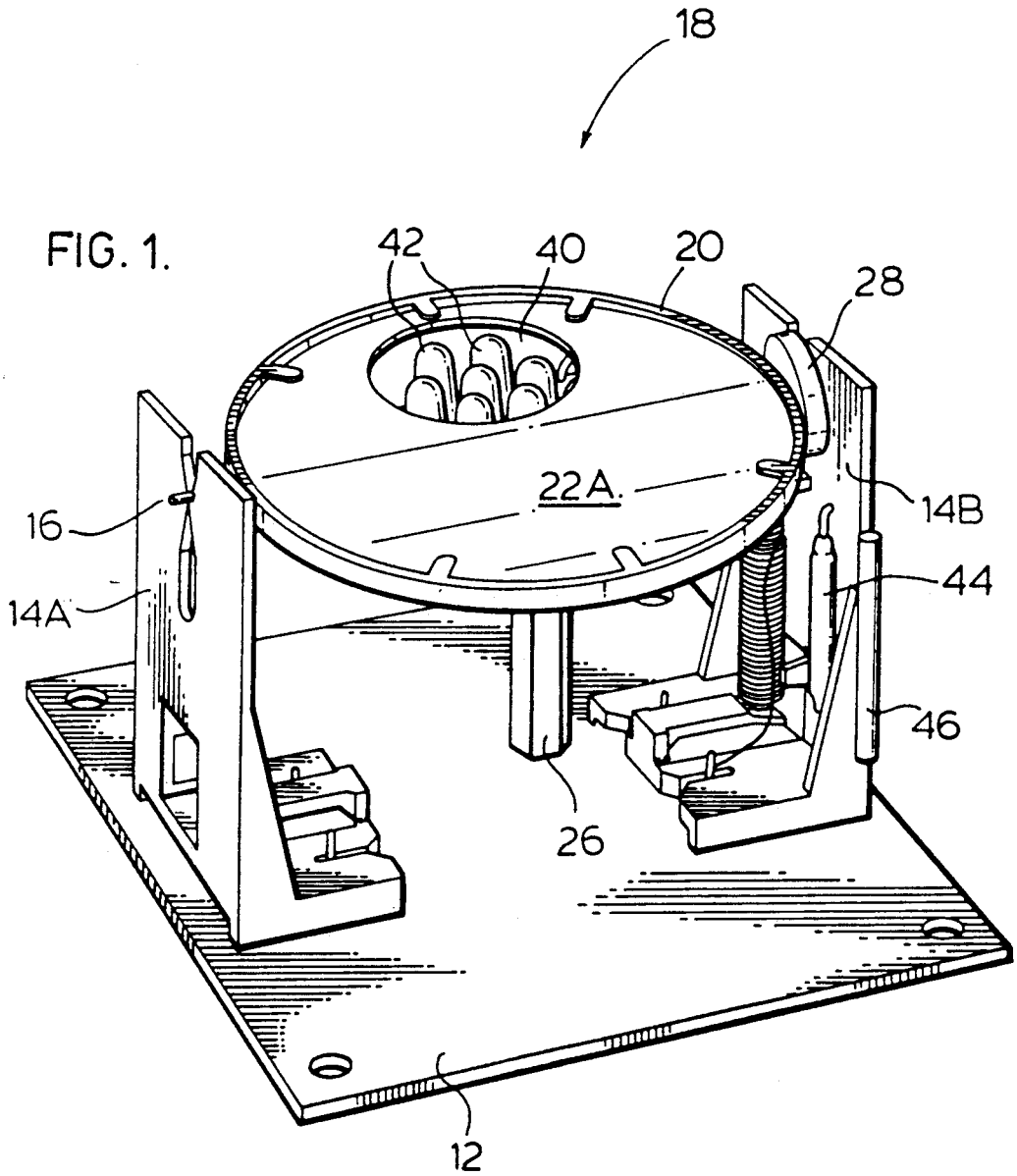
FIG. 1 is a perspective view of a display element in accord with the invention.
Figure 2:
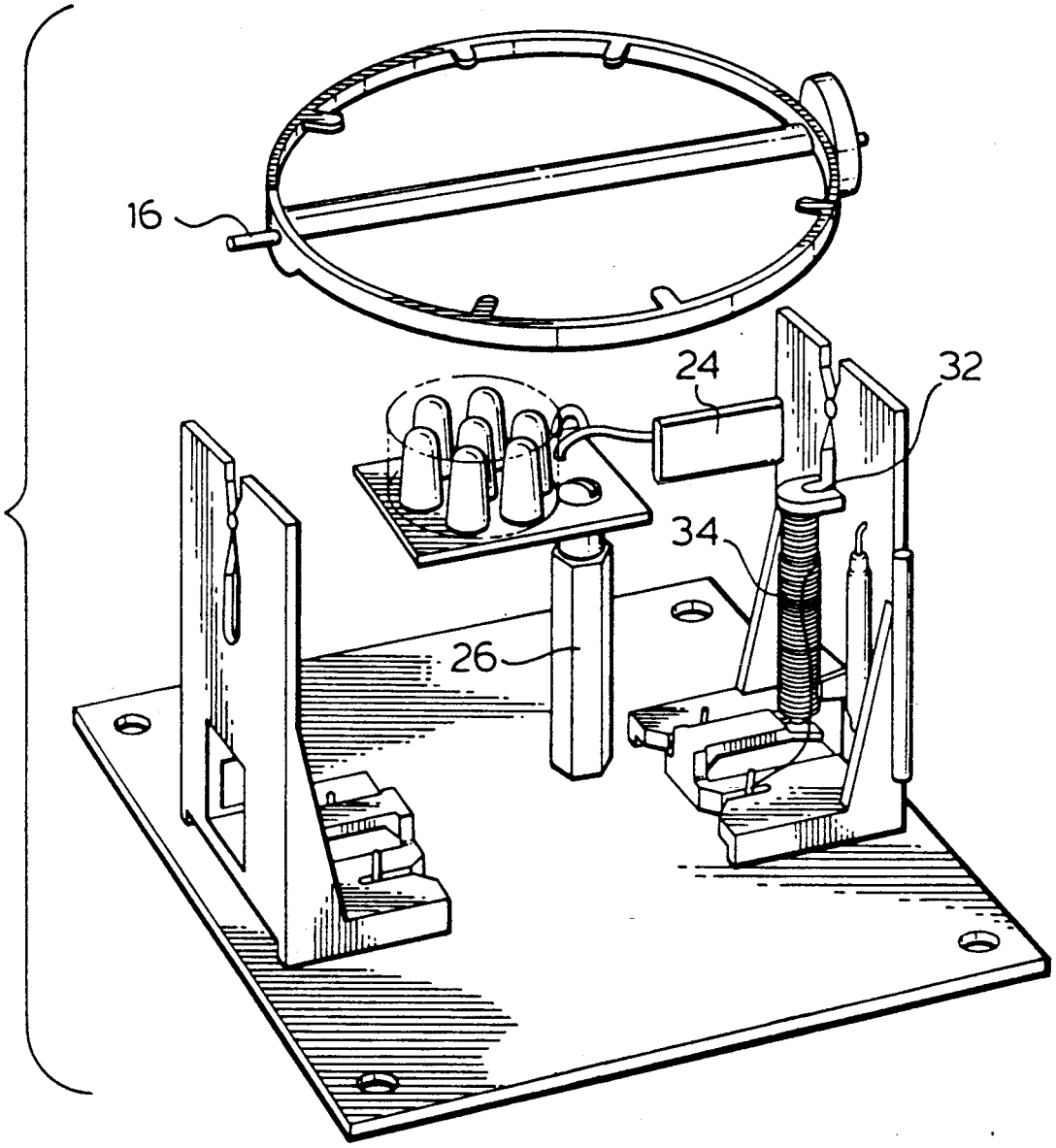
FIG. 2 is an exploded view of the device of FIG. 1.
Figure 3:
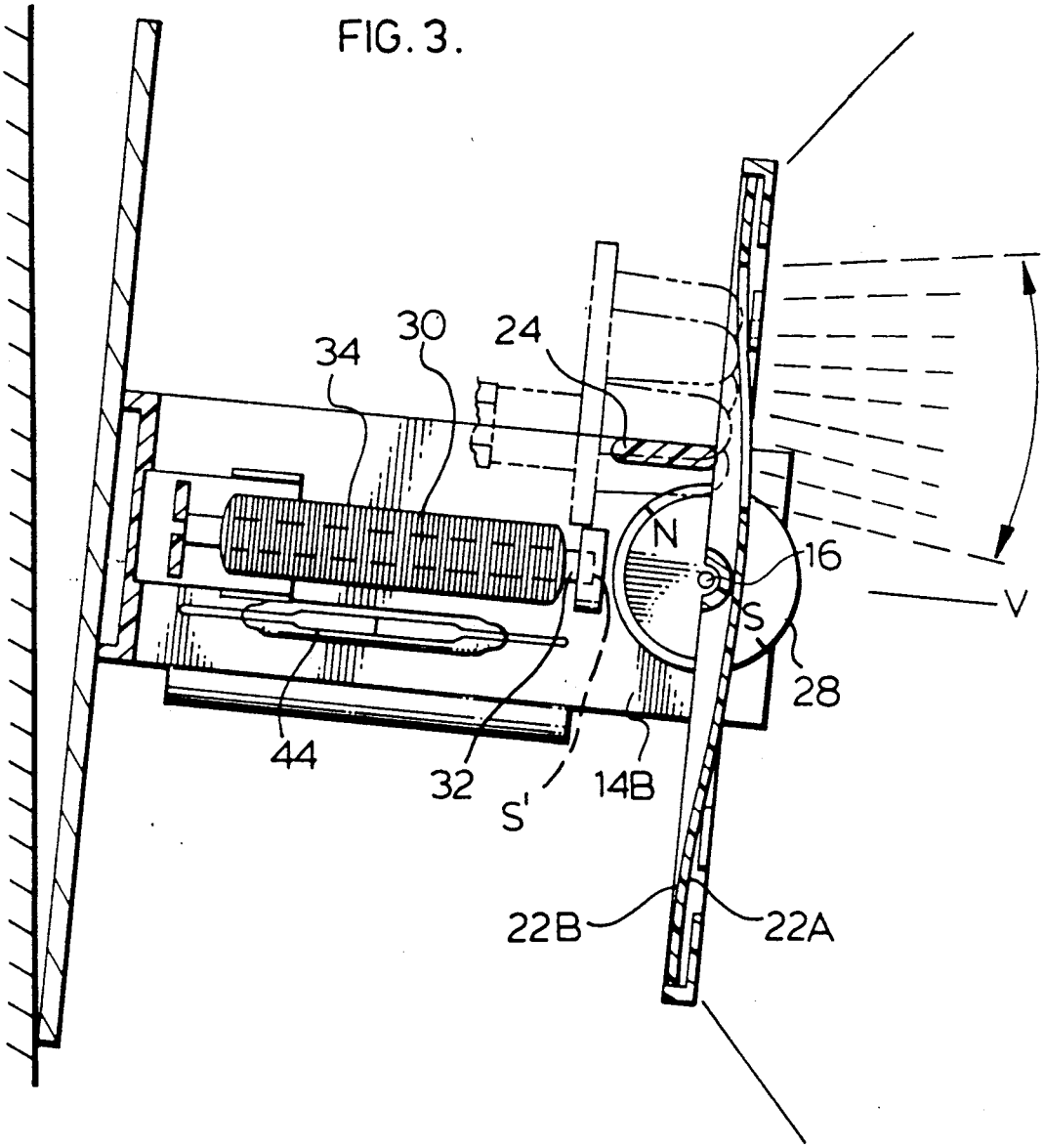
Figure 4:
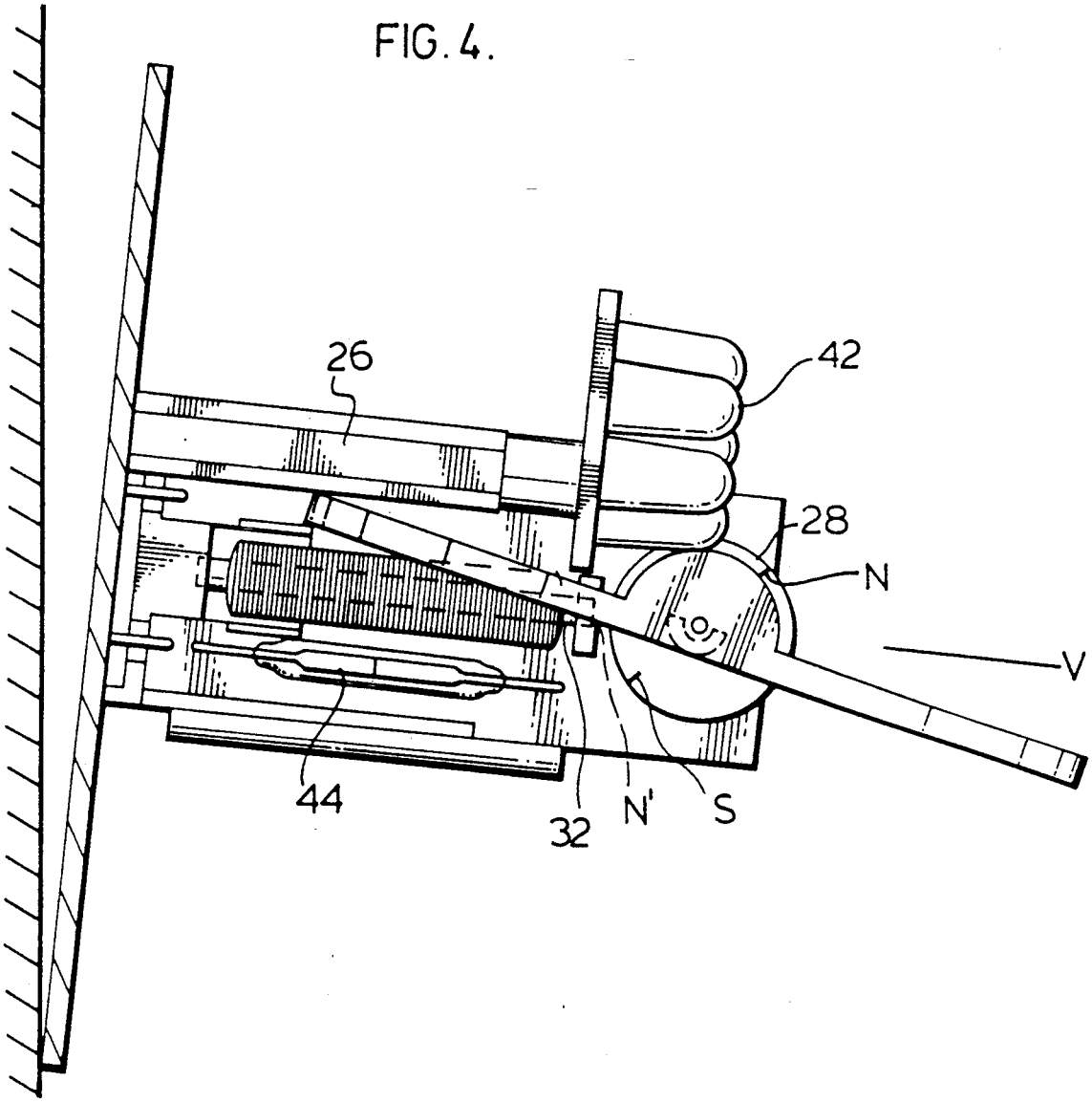
Figure 6:
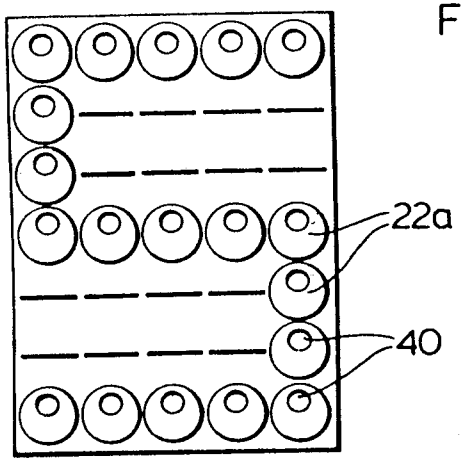
Figure 5:
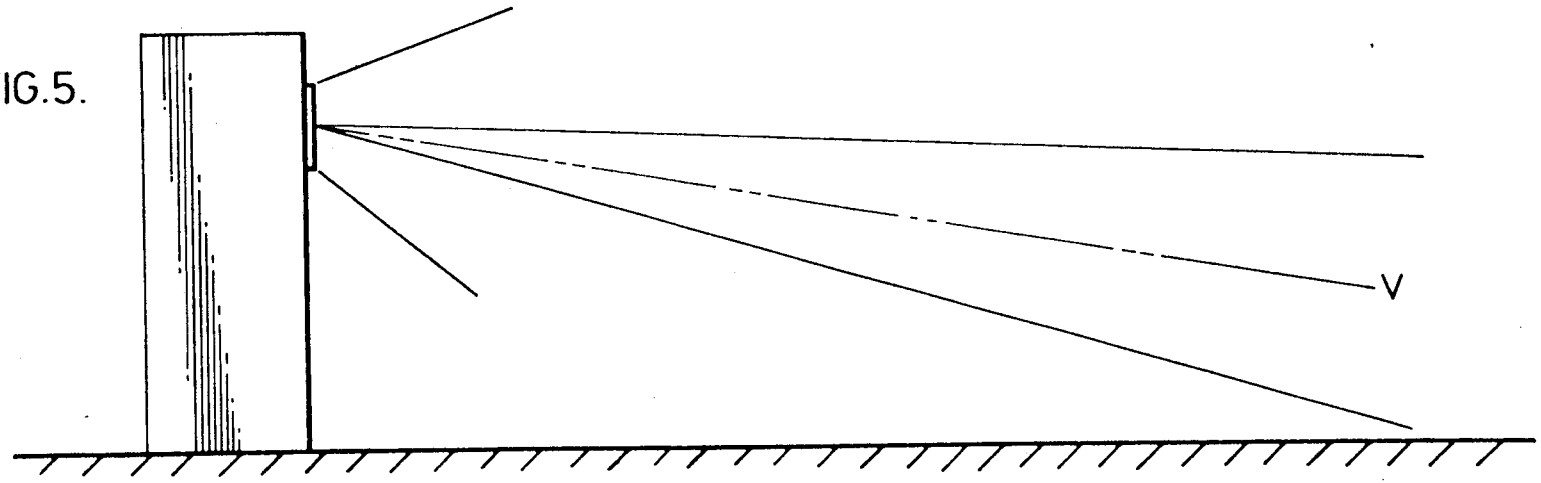
Figure 7:
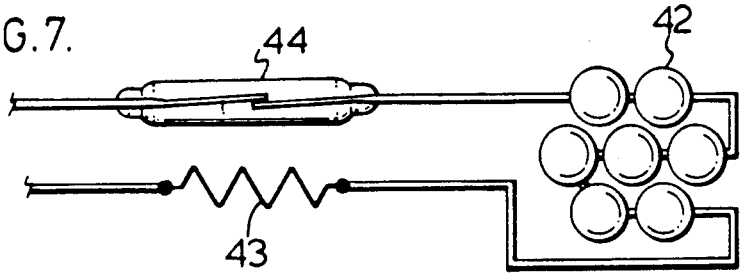
Figure 8:
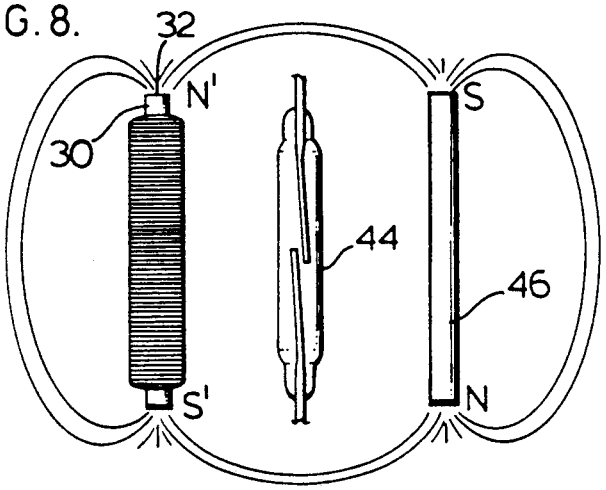
Figure 9:
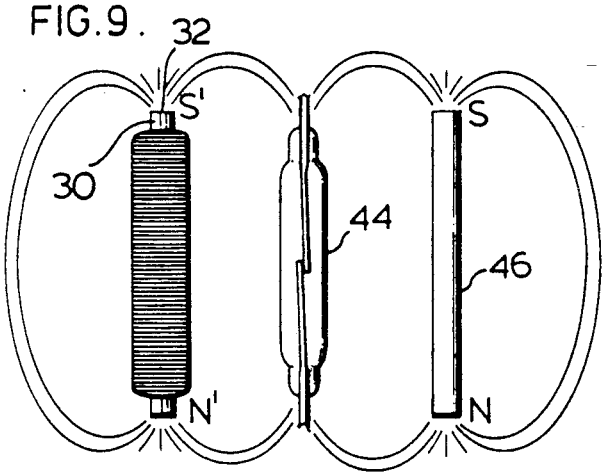
Figure 10:
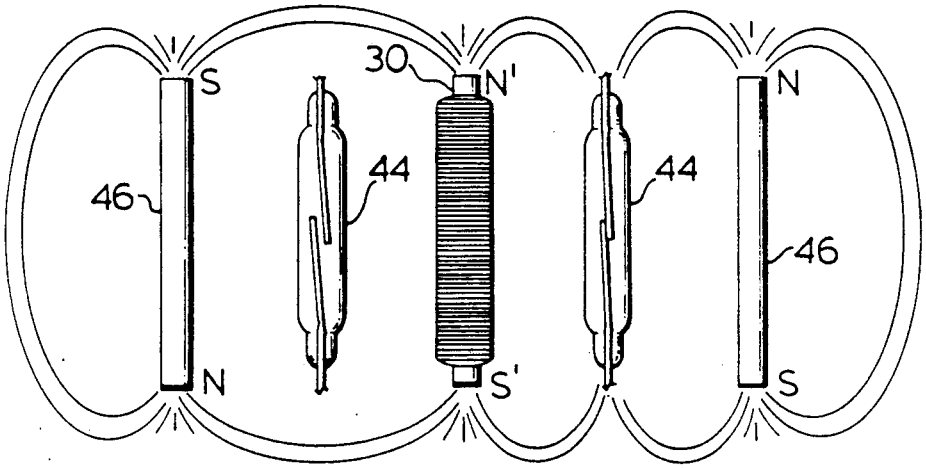

FIG. 3 is a side view, partly in section, of the device of FIG. 1, in ON position, FIG. 4 is a side view, partly in section, of the device of FIG. 3 in the OFF position, FIG. 5 is a schematic view of an array erected over a highway, FIG. 6 is a partial view of the front of the array of FIG. 5, FIG. 7 shows a circuit including the reed switch and an LED bank, FIG. 8 and 9 schematically indicate the magnetic fields with the reed switch off and on respectively, FIG. 10 schematically indicates the magnetic fields where the switchable core is combined with two reed switches, In the drawings it is proposed to describe the more conventional portions followed by the less conventional. The display element shown in FIGS. 1–4 may be either a single status element or part of an array of the type shown in FIG. 6.

FIG. 1 shows a base plate 12 supporting opposed standards 14A, 14B slotted at the outer end of the standard to mount the shaft 16 of a display disk 18.

The display disk 18 has a circular frame 20 which mounts a circle of resilient plastic material 22 as shown. The resilient plastic material 22 is brightly colored on one side 22A to be displayed in the viewing direction in the ON position (FIG. 3) where it contrasts with the background. The resilient plastic material 22 is dark on the other side 22B to match the background, (and the rim of the disk) so that the area to the viewer is bright in the ON position and is dark in the OFF position. (The resilient plastic 22 is omitted in FIG. 2).

The display disk is pivotted to rotate on shaft 16 between stop 24 mounted on standard 14B, which stops the rotation of the disk at the ON position FIG. 3 (displaying the bright face of the disk in the viewing direction V) and the pillar 26 to be described hereafter used stops the disk in the OFF position (FIG. 4). It will be noted that in the OFF position the viewer sees the dark edge of the disk and the dark background of the element where the bright disk side was in ON position.

Rotatable with the disk 18 on shaft 16 is a cylindrical permanent magnet 28 magnetized along a diameter as shown in FIGS. 3 and 4.

Core 30 of preferably high remanence magnetic material preferably of extended straight form is mounted on standard 14B to project therefrom in the viewing direction and to provide its outer pole 32 in the vicinity of the locus of permanent magnet 28. The core pole 32 is positioned relative to the magnetic axis of the permanent magnet 28 and the stops 24 and 26 to cause the disk to alternate between ON and OFF positions on each switch of polarity of pole 32. Energizing coil 34 surrounds core to provide from a source not shown, the energizing current to switch the core polarity. Preferably the core 30 is of the 'hard' or high remanence type so that the switching of the core may be performed by a very short pulse of energizing current in an interval much shorter than required for the element to mechanically move between ON and OFF position.

The magnetic torque to complete the mechanical movement and to hold the element in place afterward is provided by the remanent flux of the magnetic core, 30. The switched polarities of pole 32 are indicated as N', S'.

The element switched as described may be used alone or as part of the array of FIG. 6 as so far described operates in accord with design and operating principles well known before this development.

In accordance with the invention the bright side of the disk is augmented in the disk's ON position by the presence of a light source 'on' or illuminated in the ON position and 'off' in the OFF position under the control of a reed switch to be described.

In the preferred embodiment the disk is provided with a round aperture 40 displaced from the disk axis and a bank of seven LED's 42 is provided to shine through the aperture 40 in the ON position of the disk. The LED bank is supported on the outer end of pillar 26. The LEDs are preferably provided with focussing lenses so that their rays shine principally in a cone of 15° apex centred on viewing direction V. In FIG. 2 there is indicated in dotted form a cylindrical side wall or shroud which is preferably provided above the LED bank to limit side radiation or reflection. The side wall is not shown in the remaining Figures to allow better display of the remaining elements.

A reed switch 44 well known to those skilled in the art is supported on the base parallel and adjacent to the switchable core 30. The reed switch is designed to be closed when there is a sufficient flux field with a component along the longitudinal axis of the reed switch and open when such field is insufficient. This reed switch is normally open. A normally closed reed switch could be used although, in the preferred operating arrangement it might render the circuit more complex.

A second longitudinally extending core 46 is located parallel to the longitudinal axis reed switch 44 about equally spaced from the reed switch as core 30 and on the opposite side therefrom. The second core has preferably approximately the same remanance as core 30.

The second core is not switched but has a permanent polarization as shown.

The reed switch 44 is connected in series with the bank of LEDs as schematically shown in FIG. 7 but the LEDs could be connected in parallel with each other as determined by the supply voltage. With the circuit of FIG. 7, a resistor 43 is provided in series with the LED's to limit current to the LED's. When the reed switch is closed and open, the LED's are on and off respectively. The mode of operation of the reed switch is as demonstrated in FIGS. 8 and 9.

In FIG. 9 switchable core 30 has been switched to make pole 32, south (S') drive the display element to ON position as shown in FIG. 3. The polarity of the second core 46 is chosen so that with the switchable core 30 in ON magnetization both cores have the same polarity as shown in FIG. 9. As shown schematically in FIG. 9 some of the return flux of the two cores is combined along the length of the reed switch and the location and remanence of the cores is chosen so that the combined flux along such length closes the reed switch illuminating the LED bank which augments the bright side of the disk to a viewer in the viewing direction.

When it is desired that the disk be in OFF orientation the first core 30 is switched to make pole 32 north N' (FIG. 8). Since the first and second cores are now of opposite polarity each core acts as a preferred path for a high proportion of the other's return flux. The magnetic parameters and the reed switch are selected so that the flux along the reed switch is insufficient to close it so that it opens, extinguishing the LED bank. Thus the viewer on the highway sees a dark area of the disk (where the bright area would be in 'ON' state), being the dark background, the edge of the disk and the 'off' LED's, a dark pixel in the array shown schematically in FIG. 6.

In highway applications the LED's will customarily be provided with lenses, focussing the bright in a beam preferably 15° on the highway at a described distance from the sign. On the other hand the viewing angle for the bright disk sides and the counterpart dark pixels will be much wider usually >90°. Thus with the array showing 'S' as indicated in the 5×7 pixel array of FIG. 6, the LED's of the ON pixels rivet the motorist's attention at an early stage of his approach so he is alerted to read the message of the array created by the joint effect of the bright disk sides and the LED's in contrast to the dark pixels.

The light source may alternatively be incandescent or optic fibres. The incandescent light may be switched on and off by the reed switch just as are the LED's. The light supply of the optic fibre for each pixel may also be switched on and off if there is a separate light for each pixel fibre. If there is one light for all fibres in the array the reed switch would be connected to operate a shutter to interrupt the corresponding optic fibre path.

The first and second cores are shown oppositely disposed relative to the reed switch. Magnetic parameters can be selected so that these cores may be nearer to each other say at the corners (with the reed switch) of a equilateral triangle. Obviously the second core must be located far enough from the locus of the permanent magnet so that the second core does not affect the magnet's drive.

The first and second cores may be different distances from the reed switch (and of different remanence) as long as their locations are selected so that the flux places the reed switch in a state determined by the polarity of the first core.

The first and second cores need not be precisely parallel but compactness and ease of calculation of parameters will usually be improved if the two cores are approximately parallel.

The reed switch need not be precisely parallel to the two cores but the usual mode of operation of the reed switch requires that the cores provide return flux paths with a substantial component in the direction of the longitudinal axis of the reed switch.

The reed switch may if desired be of the type which opens for flux values above a pre-determined value and closes below such value. However, this will complicate the switching control for the light source in the arrangement of the preferred embodiment.

The reed switch may be used for other functions than the switching of the illumination. For example the reed switch, controlled as above described may be used to signal the magnetic status of the first core to a control or supervisory device.

FIG. 10 shows that more than one reed switch may be controlled by the same switchable core 30. A normally open reed switch 44 is located on each side of the switchable core. Two permanent polarity cores 46 ('second' and 'third' cores) are located each on the opposite side of a reed switch from the switchable core. The two permanent polarity cores are polarized in opposite directions as shown. At any time the combination of the return flux of the switchable core with the respective second and third cores will produce closed and an open state reed switches. These states will be reversed when the switchable core 30 is switched to the opposite polarity.

I claim:

1. In a display device having:

a movable and a stationary element, said movable element being mounted on said stationary element to move between:

an ON position where a bright surface is displayed, over an area in a viewing direction; and an OFF position means, adapted, in the OFF position of said movable element, to provide that said area appears dark in the viewing direction, a permanent magnet movable with said movable element, a high remanence magnetic first core adapted to cooperate with said permanent magnet to move said movable element to ON and OFF positions in one and the other polarity, respectively, an energizing winding about said core adapted to switch said polarity:

the improvement comprising:

a reed switch located in the return flux path of said first core, said reed switch controlling the open and closed states of an electric circuit connected thereto, a second core approximately parallel to said first core, located so that said reed switch is in the path of return flux from said second core, said first and second cores and said reed switch being located and oriented so that in said one and the other polarity of said first core the combined return flux of said first and second cores is adapted to place said reed switch in one and the other states.

2. In a display device as claimed in claim 1 wherein:

a light source is located to shine from said area in said viewing direction, means responsive to the state of said reed switch for switching said light source on and off responsive to the existence of said one and said other state.

3. In a display device as claimed in claim 2 wherein said movable element is a disk rotatable on its approximate diameter, the disk is apertured and said light source is located to shine through said aperture in the ON attitude of said disk.

4. In a display device as claimed in claim 2 wherein said area may be seen within a relatively wide cone about the viewing direction and said light source is focussed to define a narrowing beam within said cone.

5. In a display device as claimed in claim 3 wherein said area may be seen within a relatively wide cone about the viewing direction and said light source is focussed to define a narrowing beam within said cone.

6. In a display device as claimed in claim 2, 3, 4 or 5 wherein said light source is at least one light emitting diode.

7. In a display device as claimed in claim 2 wherein said reed switch is adapted to be closed when said first core is polarized to place the movable element in ON position and said reed switch is connected in series with said light source.

8. In a display device as claimed in claim 3 wherein said reed switch is adapted to be closed when said first core is polarized to place the movable element in ON position and said reed switch is connected in series with said light source.

9. In a display device as claimed in claim 4 wherein said reed switch is adapted to be closed when said first core is polarized to place the movable element in ON position and said reed switch is connected in series with said light source.

10. In a display device as claimed in claim 5 wherein said reed switch is adapted to be closed when said first core is polarized to place the movable element in ON position and said reed switch is connected in series with said light source.

11. In a display device as claimed in claim 6 wherein said reed switch is adapted to be closed when said first core is polarized to place the movable element in ON position and said reed switch is connected in series with said light source.

12. In a display device as claimed in claim 1 wherein a second reed switch is provided located in the return flux path of said first core and a third core is provided approximately parallel to said first core, located so that said second reed switch is in the path of return flux from said third core, said first and third cores and said second reed switch being located and oriented so that in one and the other polarity of said first core the combined return flux of said first and second cores is adapted to place said second reed switch in one and the other states.

13. In a display device as claimed in claim 12 wherein said second and third cores are oppositely polarized.

14. In a display device having:

a movable and a stationary element, said movable element having a light surface and a dark surface being mounted on said stationary element to move between:

an ON position where said light surface is displayed over an area in a viewing direction;

an OFF position where said dark surfaces are displayed over such area, a permanent magnet movable with said movable element, a high remanence magnetic first core adapted to cooperate with said permanent magnet to move said movable element to ON and OFF positions in one and the other polarity, respectively, an energizing winding about said core adapted to switch said polarity, at least one light emitting diode located to augment in said ON position the appearance in the viewing direction of said light surface area, means for switching said light emitting diode on when said movable element is in the ON position and for switching said light emitting diode off when said movable element is in the OFF position.

15. In a display device as claimed in claim 14 wherein said moving element is a disk rotating on its approximate diameter, the disk is apertured and said light source is located to shine through said aperture in the ON position of said disk.

* * * * *